US011653744B1

(12) United States Patent
Whitfield

(10) Patent No.: US 11,653,744 B1
(45) Date of Patent: May 23, 2023

(54) BULLETPROOF BACKPACK

(71) Applicant: Maurice Whitfield, Northridge, CA (US)

(72) Inventor: Maurice Whitfield, Northridge, CA (US)

( * ) Notice: Subject to any disclaimer, the term of this patent is extended or adjusted under 35 U.S.C. 154(b) by 0 days.

(21) Appl. No.: 17/901,081

(22) Filed: Sep. 1, 2022

Related U.S. Application Data

(60) Provisional application No. 63/348,222, filed on Jun. 2, 2022.

(51) Int. Cl.
*A45F 3/06* (2006.01)
*A45C 13/30* (2006.01)
*F41H 1/02* (2006.01)

(52) U.S. Cl.
CPC ..... *A45F 3/06* (2013.01); *A45C 13/30* (2013.01); *F41H 1/02* (2013.01)

(58) Field of Classification Search
USPC ..... 2/2.5, 461, 267, 84; 224/153
See application file for complete search history.

(56) References Cited

U.S. PATENT DOCUMENTS 4,266,297 A * 5/1981 Atkins ..... F41H 1/02 2/2.5
4,689,831 A * 9/1987 Greenberger ..... A45F 4/12 2/93
4,830,245 A 5/1989 Arakaki
5,149,203 A * 9/1992 Sacks ..... F41H 5/0478 190/125
5,165,111 A * 11/1992 Lieberman ..... A45F 3/04 2/108
5,784,719 A * 7/1998 Robinson ..... A41D 3/00 2/93
6,161,738 A * 12/2000 Norris ..... F41H 5/0457 383/119
6,185,738 B1 * 2/2001 Sidebottom ..... F41H 1/02 2/2.5
6,314,579 B1 * 11/2001 Marcon ..... A41D 13/0125 2/102
6,419,132 B1 7/2002 Reed et al.
(Continued)

FOREIGN PATENT DOCUMENTS

WO WO-2014101245 A1 * 7/2014 ..... A45C 13/02

*Primary Examiner* — Tajash D Patel
(74) *Attorney, Agent, or Firm* — Nolan Heimann LLP; Adam Diament

(57) ABSTRACT

A bulletproof backpack is disclosed. The bulletproof backpack includes a body having a front section, a rear section, a base, and a cover section. The front section, the rear section, the base, and the cover section form an interior of the body. The bulletproof backpack includes a first panel connecting the rear section. The bulletproof backpack includes a hood extending from the cover section. The bulletproof backpack includes a second panel connecting the hood. The bulletproof backpack includes shoulder straps connecting the rear section allowing a user to carry the bulletproof backpack. The bulletproof backpack includes strap connectors extending from the hood. Each of the first panel and the second panel is capable of blocking bullets and explosion fragments for protecting the user's back and head, respectively. The strap connectors connect the shoulder straps to balance the weight of the hood and prevent the hood from falling back.

20 Claims, 5 Drawing Sheets

(56) References Cited

U.S. PATENT DOCUMENTS

| | | | | |
|---|---|---|---|---|
| 8,776,291 | B1 * | 7/2014 | Lewis | A61G 1/013 5/628 |
| 9,801,452 | B2 | 10/2017 | Duthoit | |
| 9,820,558 | B1 * | 11/2017 | de Geus | F41H 1/02 |
| 10,051,945 | B1 * | 8/2018 | Pomare | A45F 3/02 |
| 10,874,199 | B2 * | 12/2020 | James | A45F 4/12 |
| 2009/0014490 | A1 | 1/2009 | Bradley | |
| 2020/0263959 | A1 * | 8/2020 | Dieffenbach | A45F 3/04 |

* cited by examiner

BULLETPROOF BACKPACK

CROSS-REFERENCE TO RELATED APPLICATIONS

This application claims priority to U.S. Provisional Patent Application No. 63/348,222, filed on Jun. 2, 2022 to Whitfield, the contents of which are incorporated by reference in its entirety.

FIELD OF THE DISCLOSURE

The present invention relates to a backpack, and more specifically, to a bulletproof backpack.

BACKGROUND OF THE INVENTION

Protecting children from violence, especially gun violence, is a top priority for parents. There are few options where children can have handy, readymade solutions for protecting themselves. While bulletproof devices exist, it is not common for children to always be carrying bulletproof devices that can protect themselves.

There are some backpacks that offer bulletproof features. These include U.S. Pat. Pub. No. US20090014490A1, entitled "Bulletproof Backpack," to Bradley. Another is U.S. Pat. No. 6,419,132, entitled, "Backpack with Deployable Armor," to Reed et al. Yet another is U.S. Pat. No. 4,830,245, entitled "Backpack Carrier and Shield," to Arakaki. Yet another is U.S. Pat. No. 9,801,452, entitled "Backpack with Ballistic Insert," to Duthoit. All references to U.S. patent applications, publications, and patents are hereby incorporated by reference in their entireties for all purposes.

However, there remains a continuing need for improved devices that have bulletproof features.

BRIEF SUMMARY OF THE PRESENT INVENTION

The present invention provides a backpack that has bulletproof materials built into the backpack and an optional hood that also has bulletproof features.

In one aspect, the present invention provides a bulletproof backpack. The bulletproof backpack includes a body having a front section, a rear section, a base, and a cover section. The front section, the rear section, the base, and the cover section form an interior of the body. The bulletproof backpack includes a first panel connecting the rear section. The bulletproof backpack includes a hood extending from the cover section. The bulletproof backpack includes a second panel connecting the hood. The bulletproof backpack includes shoulder straps connecting the rear section allowing a user to carry the bulletproof backpack. The bulletproof backpack includes strap connectors (i.e. a plurality of strap connectors) extending from the hood. Each of the first panel and the second panel is capable of blocking bullets and explosion fragments for protecting the user's back and head, respectively. The strap connectors connect the shoulder straps to balance the weight of the hood and prevent the hood from falling back.

Further, the shoulder straps include strap panels. The strap panels are capable of blocking bullets and explosion fragments for protecting the user's torso area. The shoulder straps include a connecting mechanism. The connecting mechanism helps to distribute the weight of the bulletproof backpack evenly over the shoulders of the user.

In one advantageous feature of the present invention, the bulletproof backpack protects the lives of children/adults in a situation involving gun violence. The bulletproof backpack includes a waterproof backpack with the ability to hold books, laptops, pens, pencils, water bottles, clothing, etc., and a bulletproof panel that will fit inside the backpack in order to protect the back of the child/adult wearing the backpack. The bulletproof backpack further includes a waterproof hood that is attachable thereto via a zipper or any other mechanism located near the neck area.

In another advantageous feature of the present invention, the shoulder straps on the front of the bulletproof backpack are provided with bulletproof panels to protect the vital organs at the front of the child/adult wearing the backpack.

In some aspects, the techniques described herein relate to a method of providing a bulletproof backpack, said method including the steps of: providing a body including a front section, a rear section, a base, and a cover section, said front section, said rear section, said base, and said cover section forming an interior of said body; providing a hood extending from said cover section; providing a first panel connecting said rear section, and a second panel connecting said hood, said first panel and said second panel capable of blocking bullets and explosion fragments and protecting a user's back and head, respectively; providing shoulder straps connecting said rear section for allowing the user to carry said bulletproof backpack; providing strap connectors extending from said hood; and connecting said strap connectors to said shoulder straps for balancing weight of said hood and preventing said hood from falling back.

DETAILED DESCRIPTION OF EMBODIMENTS

Figure 1A:
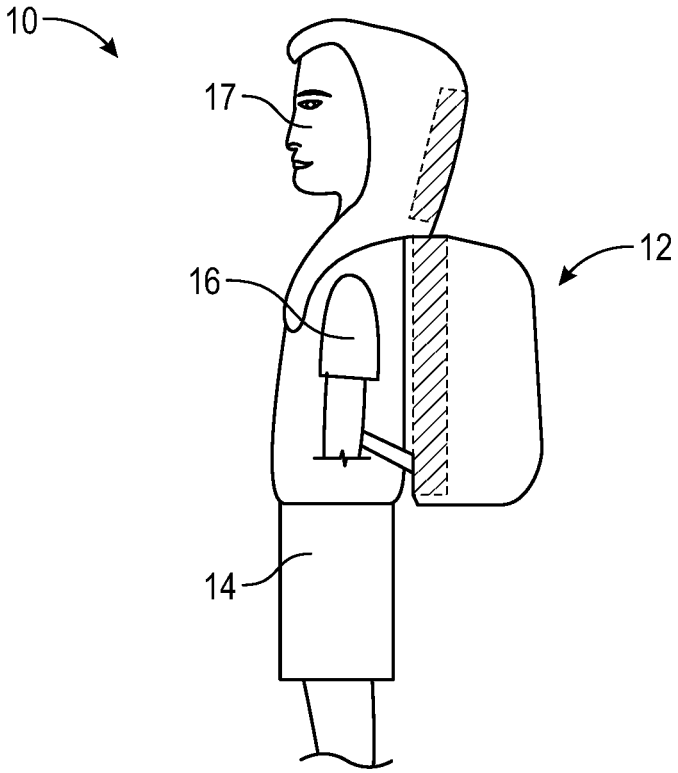
FIGS. 1A and 1B illustrate an environment in which a bulletproof backpack implements, in accordance with one embodiment of the present invention.

The invention now will be described more fully hereinafter with reference to the accompanying drawings, in which embodiments of the invention are shown. This invention may however be embodied in many different forms and should not be construed as limited to the embodiments set forth herein. Rather, these embodiments are provided so that this disclosure will be thorough and complete, and will fully convey the scope of the invention to those skilled in the art.

It will be understood that when an element is referred to as being "on" another element, it can be directly on the other element or intervening elements may be present therebetween. As used herein, the term "and/or" includes any and all combinations of one or more of the associated listed items.

It will be understood that, although the terms first, second, third etc. may be used herein to describe various elements, components, regions, layers, and/or sections, these elements, components, regions, layers, and/or sections should not be limited by these terms. These terms are only used to distinguish one element, component, region, layer, and/or section from another element, component, region, layer, and/or section.

It will be understood that the elements, components, regions, layers and sections depicted in the figures are not necessarily drawn to scale.

The terminology used herein is for the purpose of describing particular embodiments only, and is not intended to be limiting of the invention. As used herein, the singular forms "a," "an," and "the" are intended to include the plural forms as well, unless the context clearly indicates otherwise. It will be further understood that the terms "comprises" and/or "comprising," or "includes" and/or "including" when used in this specification, specify the presence of stated features, regions, integers, steps, operations, elements, and/or components, but do not preclude the presence or addition of one or more other features, regions, integers, steps, operations, elements, components, and/or groups thereof.

Furthermore, relative terms, such as "lower" or "bottom," "upper" or "top," "left" or "right," "above" or "below," "front" or "rear," may be used herein to describe one element's relationship to another element as illustrated in the Figures. It will be understood that relative terms are intended to encompass different orientations of the device in addition to the orientation depicted in the Figures.

Unless otherwise defined, all terms used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and the present disclosure, and will not be interpreted in an idealized or overly formal sense unless expressly so defined herein.

Exemplary embodiments of the present invention are described herein with reference to idealized embodiments of the present invention. As such, variations from the shapes of the illustrations as a result, for example, of manufacturing techniques and/or tolerances, are to be expected. The numbers, ratios, percentages, and other values may include those that are ±5%, ±10%, ±25%, ±50%, ±75%, ±100%, ±200%, ±500%, or other ranges that do not detract from the spirit of the invention. The terms about, approximately, or substantially may include values known to those having ordinary skill in the art. If not known in the art, these terms may be considered to be in the range of up to ±5%, ±10%, or other value higher than these ranges commonly accepted by those having ordinary skill in the art for the variable disclosed. Thus, embodiments of the present invention should not be construed as limited to the particular shapes of regions illustrated herein but are to include deviations in shapes that result, for example, from manufacturing. The invention illustratively disclosed herein suitably may be practiced in the absence of any elements that are not specifically disclosed herein. All patents, patent applications and non-patent literature cited through this application are hereby incorporated by reference in their entireties.

Figure 1B:
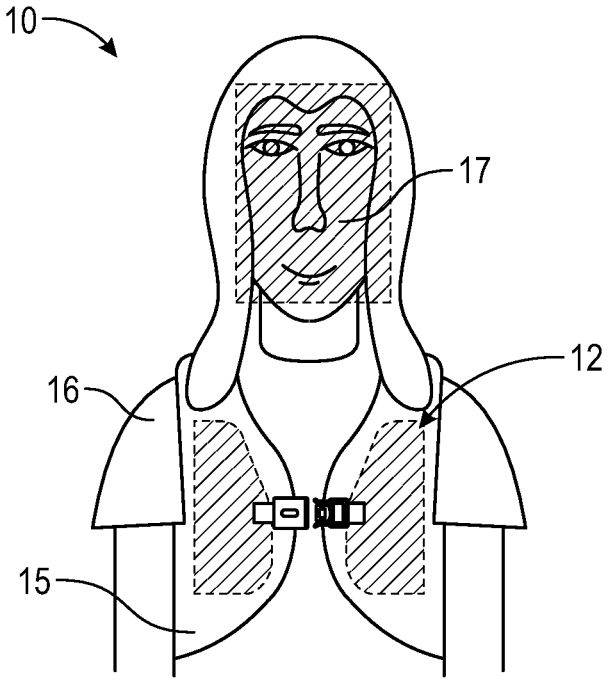

Turning to the Figures, FIGS. 1A and 1B show an environment 10 in which a bulletproof backpack 12 implements, in accordance with one exemplary embodiment of the present invention. Bulletproof backpack 12 is carried by a user 14 using shoulder straps 15. User 14 carries bulletproof backpack 12 over his shoulder 16 and protects his torso, chest, back and head 17 in the event of a gunfire and other ballistic impacts fired at user 14.

Figure 2A:
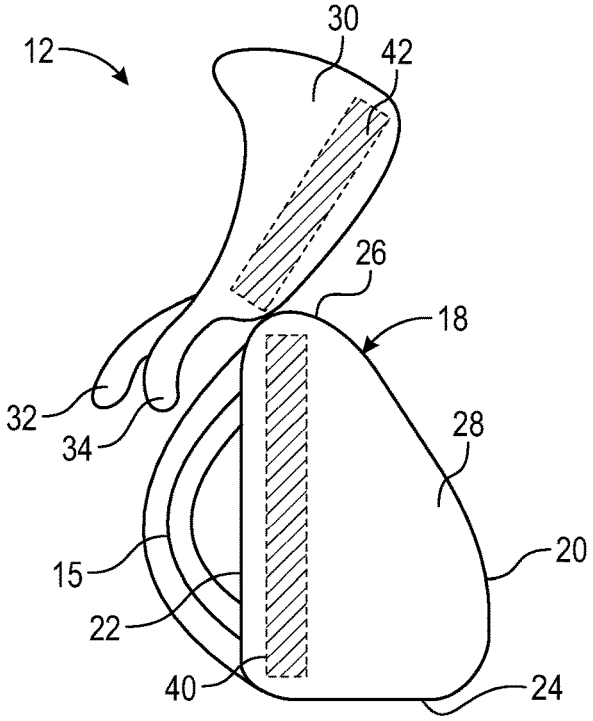
FIGS. 2A and 2B illustrate a side view and a front view, respectively of the bulletproof backpack, in accordance with one embodiment of the present invention.
Figure 2B:
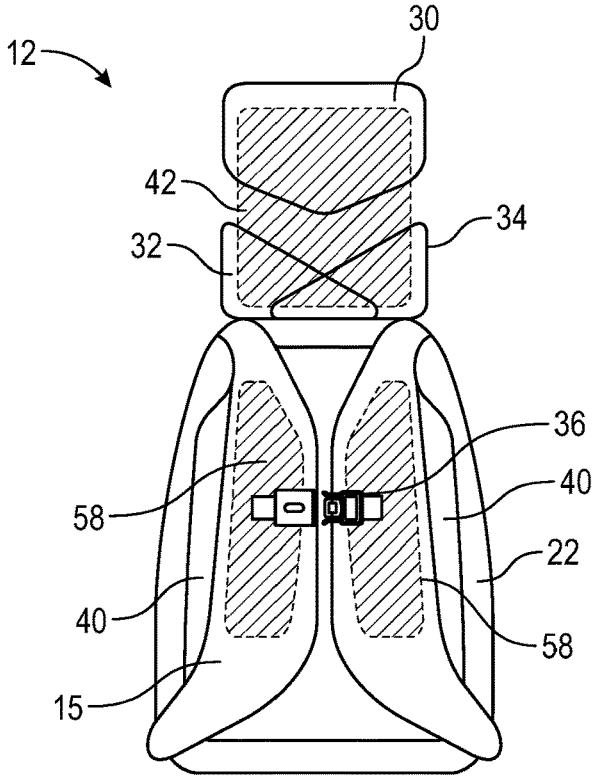

FIGS. 2A and 2B show a side view and a front view, respectively of bulletproof backpack 12, in accordance with one embodiment of the present invention. Bulletproof backpack 12 includes a body 18. Body 18 is made of a durable fabric such as cloth, nylon, canvas, etc. Body 18 is waterproof. Body 18 encompasses a front section 20, a rear section 22, a base 24 and a cover section 26. Rear section 22 has a substantially flat configuration and rests comfortably against user's 14 back, as shown in FIG. 1A, for example. Base 24 indicates a bottom section of body 18. Front section 20, rear section 22, base 24 and cover section 26 form an interior 28. Interior 28 holds books, laptops, pens, pencils, water bottles, clothing, etc. Cover section 26 indicates a top section that acts as an access point for accessing interior 28 of body 18 from the top. In one example, cover section 26 includes a zipper for providing access to interior 28 of body 18. In another example, cover section 26 includes buttons, threads, hook and loops or any other known mechanism for providing access to interior 28 of body 18.

Figure 3:
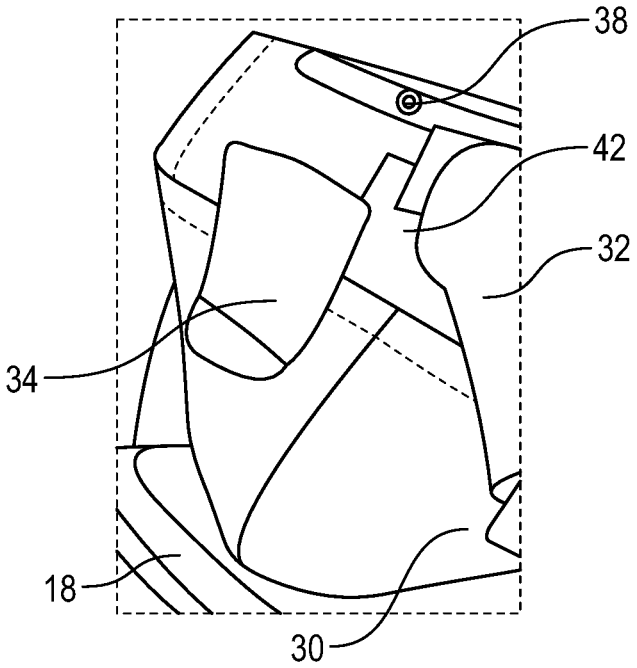
FIGS. 3 and 4 illustrate a hood having strap connectors, in accordance with one embodiment of the present invention.
Figure 4:
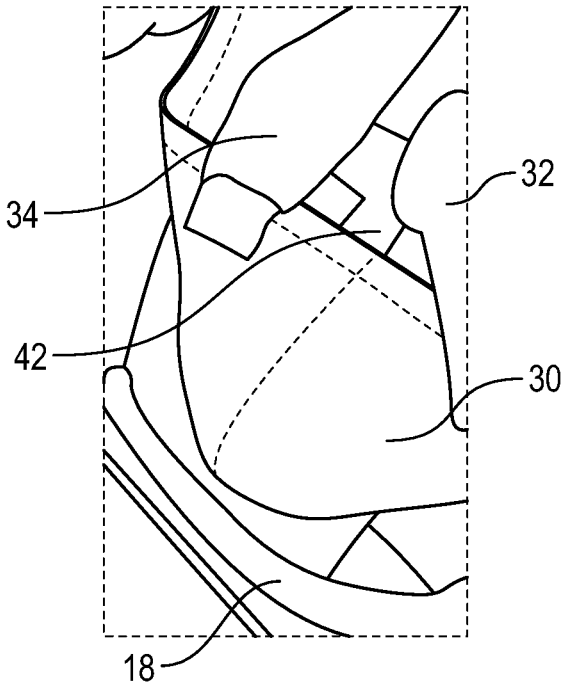

Further, bulletproof backpack 12 includes a hood 30. Hood 30 extends from cover section 24 or at distal end of rear section 22. Hood 30 is made of a durable fabric such as cloth, nylon, canvas, etc. Hood 30 is waterproof and is attachable to rear section 22 or cover section 24 via a zipper (not shown). In one embodiment, hood 30 is sewn in and can be located in a pocket, such as a zippered pocket at rear section 22 or cover section 24. Hood 30 includes a first strap connector 32 and a second strap connector 34. Each of first strap connector 32 and second strap connector 34 indicates a fabric that extends from distal ends of hood 30. Here, each of first strap connector 32 and second strap connector 34 appears like an ear (fluffy ear) extending from the ends of hood 30. First strap connector 32 and strap connector 34 encompasses hook and loops (not shown) at their distal ends for connecting to shoulder straps 15, as shown in FIG. 1B, for example. First strap connector 32 and second strap connector 34 connect to shoulder straps 15 to balance the weight of hood 30 and to prevent hood 30 from falling back. Further, hood 30 includes connecting members 38 (say female members), as shown in FIG. 3. Connecting member 38 receives a connecting member (not shown, say a male member) provided at each of first strap connector 32 and second strap connector 34 and helps to connect first strap connector 32 and strap connector 34 to hood 30 when not in use, as shown in FIG. 4.

Shoulder straps 15 extend from the top of rear section 22 and connect to base 24 and/or bottom of rear section 22. Shoulder straps 15 encompasses a connecting mechanism 36 such as a buckle mechanism (with a male member extending from one shoulder strap 15 and a female member extending from another shoulder strap 15). Connecting mechanism 36 helps to distribute the weight of bulletproof backpack 12 evenly over shoulders 16 of user 14.

Bulletproof backpack 12 encompasses one or more panels, in accordance with one embodiment of the present invention. The one or more panels indicate protective plates configured to block bullets, explosion fragments, or the like. In one example, the one or more panels are made of a bullet-stopping material, such as Kevlar® and Spectra®. Optionally, the one or more panels are made of bulletproof fabric having layers of anti-ballistic materials (e.g., Kevlar® and Spectra®). The one or more panels can be selected from any material suitable for impeding the path of a projectile. Some suitable materials include ceramic, metal, Kevlar®, Lexan®, carbon fiber and other composite materials, honeycomb materials, polyethylene, and many others. In one example, when the one or more panels come in a metal plate configuration, then the one or more panels are placed in bulletproof backpack 12 in a pocket or compartment (not shown). Alternatively, when the one or more panels come in a fabric configuration, then the one or more panels is sewed to bulletproof backpack 12.

While many types of bulletproof materials may be used, one such material is a bulletproof vest plate called "Mujing PE Bulletproof Board NIJ3A Three-Level Composite" available here, https://www.amazon.com/MUJING-Bulletproof-Three-Level-Composite-Version/dp/B089YF2CFJ. Other materials known to have bulletproof properties and may be incorporated into the present invention and include: ceramic, graphene, fiberglass, Kevlar®, and polycarbonates.

Figure 6:
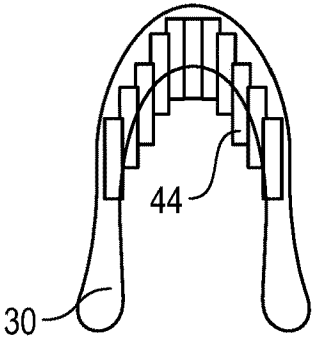
FIG. 6 illustrates a third panel placed in a hood, in accordance with one embodiment of the present invention.
Figure 5B:
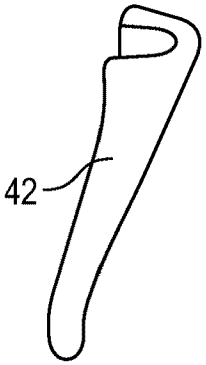
FIGS. 5A, and 5B illustrate a front view and a side view, respectively of a second panel, in accordance with one embodiment of the present invention.
Figure 5A:
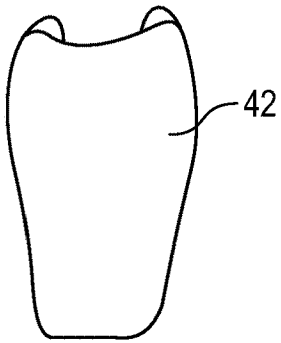

In the present embodiment, the one or more panels includes a first panel 40 and a second panel 42. First panel 40 comes in a substantially flat and rectangular configuration and connects at rear section 22 of body 18 as shown in FIG. 2A. A person skilled in the art understands that first panel 40 protects the back of user 14 when bulletproof backpack 12 is carried by user 14, as shown in FIGS. 1A and 1B, for example. Optionally, first panel 40 connects at front section 20 of body 18. Second panel 42 comes in a shape of hood 30 or back of head 17 of user 14. FIGS. 5A and 5B show a front view and a side view, respectively of second panel 42, in accordance with one embodiment of the present invention. Second panel 42 connects at the inner side of hood 30. Second panel 42 is contoured for comfort around head 17 and the neck area of user 14 when user 14 puts on hood 30 over the head 17 as shown in FIGS. 1A and 1B, for example. Optionally, hood 30 encompasses a plurality of third panels 44 (bulletproof panels), as shown in FIG. 6. Plurality of third panels 44 positions within small pockets (not shown) provided in hood 30. Plurality of third panels 44 allows more fluid/flow like motion of hood 30 for comfort of user 14.

Figure 7:
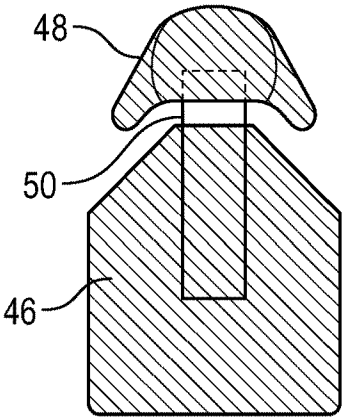
FIG. 7 illustrates a back panel and a top panel connected by a connecting panel, in accordance with one embodiment of the present invention.

In one embodiment, the one or more panels includes a back panel 46 and a top panel 48 connected by a connecting panel 50, as shown in FIG. 7. Back panel 46 configures to protect the back of user 14, top panel 48 configures to protect head 17 of user 14 and connecting panel 50 acts as a joining member/intermediary member connecting back panel 46 and top panel 48 and protects the neck area. In this embodiment, back panel 46, top panel 48 and connecting panel 50 are connected within bulletproof backpack 12 as a single integrated unit.

Figure 8:
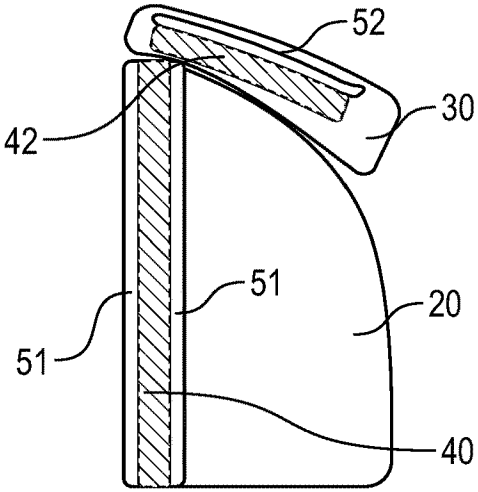
FIG. 8 illustrates panels having cushion members, in accordance with one embodiment of the present invention.

Optionally, each of first panel 40 and second panel 42 is provided with a first cushion member 51 and a second cushion member 52, respectively as shown in FIG. 8. First cushion member 51 and second cushion member 52 provide extra padding for added comfort for user 14 when user 14 carries bulletproof backpack 12. Further, first cushion member 51 and second cushion member 52 prevent first panel 40 and second panel 42 from bumping, rubbing or poking against user's 14 back and head 17 during use.

Figure 10:
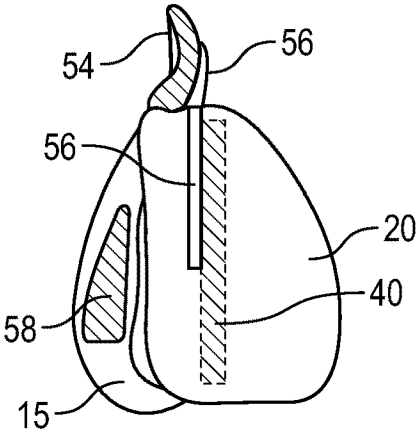
FIG. 9 and FIG. 10 illustrate a neck panel, and the bulletproof backpack incorporating the neck panel, in accordance with one embodiment of the present invention.
Figure 9:
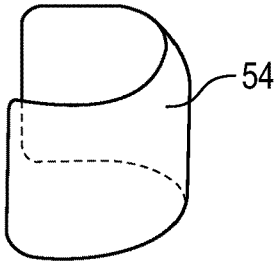

Optionally, the one or more panels includes a neck panel 54 as shown in FIG. 9. Neck panel 54 is curved in order to surround the head and neck area of user 14. Neck panel 54 acts as a high collar and provides peripheral vision of user 14. Neck panel 54 configures for use in the absence of hood 30. In other words, neck panel 54 is used when hood 30 is not available or not needed. Neck panel 54 protects the sides of head 17. FIG. 10 shows an embodiment of bulletproof backpack 12 incorporating neck panel 54, in accordance with one exemplary embodiment of the present invention. In one example, neck panel 54 includes cushion plate 56 for providing extra padding for added comfort for user 14.

Referring to FIGS. 1B and 2B, shoulder straps 15 include strap panels 58. A person skilled in the art understands that strap panels 58 position inside of shoulder straps 15 and are hidden from viewing for others. Strap panels 58 include panels or fabric that are capable of blocking bullets, explosion fragments, or the like. Strap panels 58 extend partially or the entire length of shoulder straps 15, as shown in FIG. 1B. Strap panels 58 come in a variety shapes and sizes and help to protect vital organs in case of an attack or firing from the front of user 14.

When needed, user 14 carries bulletproof backpack 12 over his shoulder 16 and places hood 30 over his head 17 as shown in FIGS. 1A and 1B. Here, first panel 40 and second panel 42 provide protection against gunfire and other ballistic impacts fired at user 14 with his/her back turned toward the shooter. Further, strap panels 58 provide protection against gunfire and other ballistic impacts fired at user 14 with user's 14 face 17 facing the shooter. If needed, user 14 may also wear bulletproof backpack 12 in another configuration, whereby body 18 is placed on the chest of user 14 and hood 30 covering face 17 of user 14.

Figure 13:
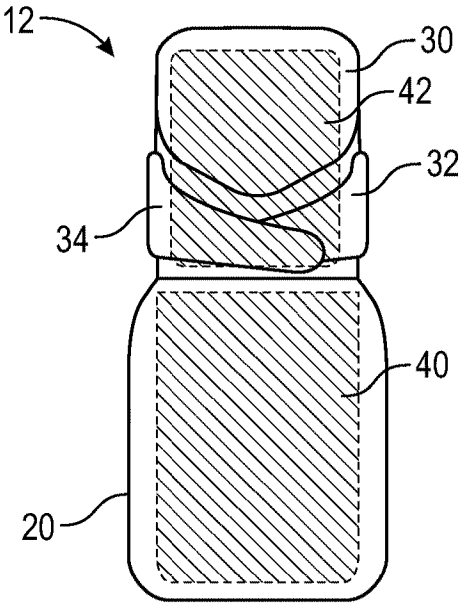
FIG. 11, FIG. 12, FIG. 13, FIG. 14, and FIG. 15 through 15 illustrate the feature of folding of the hood over the body, in accordance with one embodiment of the present invention.
Figure 12:
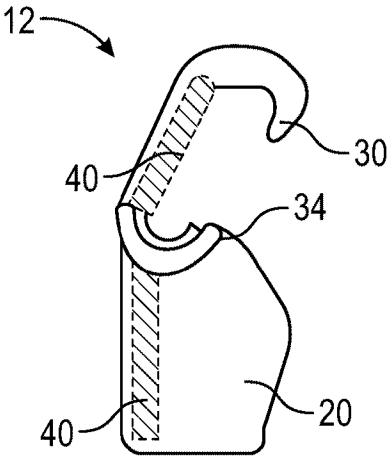
Figure 15:
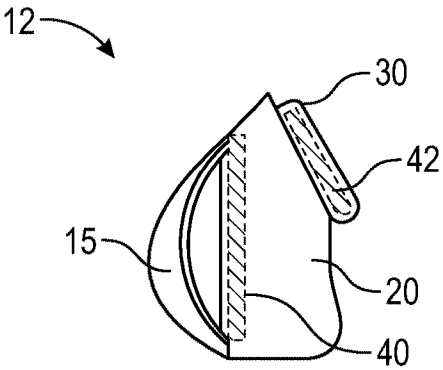
Figure 11:
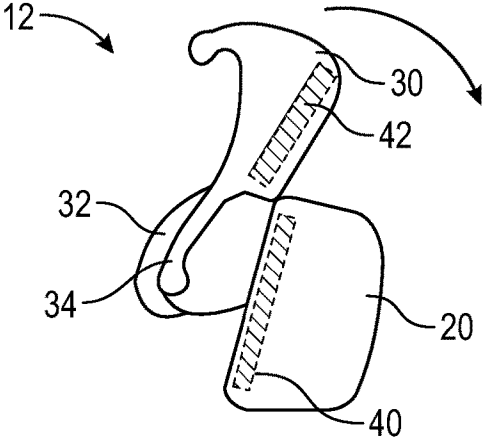
Figure 14:
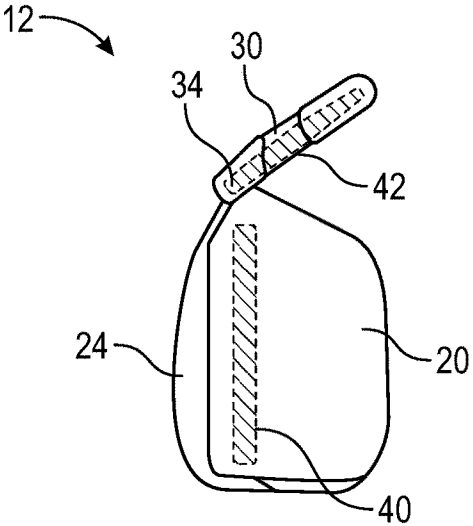

When not in use, user 14 folds hood 30 over body 18. Referring to FIGS. 11 through 15, folding of hood 30 over body 18 is explained. FIG. 11 shows a side view of bulletproof backpack 12 in which first strap connector 32 and second strap connector 34 are disconnected from shoulder straps 15. Subsequently, user 14 pulls back hood 30 and first strap connector 32 and second strap connector 34 towards front section 20 of body 18 as shown in FIG. 12. Further, user 14 folds hood 30 and wraps first strap connector 32 and second strap connector 34 around hood 30 as shown in FIG. 13. In one example, strap connector 32 and second strap connector 34 wrap around with the help of buttons or hook and loops. Further, user 14 closes hood 30 towards cover section 26, as shown in FIG. 14. Further, hood 30 positions over cover section 26, as shown in FIG. 15 and secures hood 30 in a zipper pocket (not shown) at cover section 16.

The presently disclosed bulletproof backpack provides several advantages over the prior art. For instance, the bulletproof backpack protects the life of the user/carrier in dangerous situations such as an open-fire or active shooter situation. The bulletproof backpack protects the back, head and the torso area of the user without requiring separate equipment. The bulletproof backpack allows the user to act freely without inconvenience in dangerous situations. The bulletproof backpack includes strap connectors that extend from the hood. The strap connectors connect to the shoulder straps to balance the weight of the hood and prevent the hood from falling back. When not in use, the strap connectors wrap around the hood and fall back over the body of the bulletproof backpack allowing the user to walk without the hood over his/her head.

While the invention has been described in terms of exemplary embodiments, it is to be understood that the words that have been used are words of description and not of limitation. As is understood by persons of ordinary skill in the art, a variety of modifications can be made without departing from the scope of the invention defined by the following claims, which should be given their fullest, fair scope.

What is claimed is:

1. A bulletproof backpack, comprising:

a body comprising a front section, a rear section, a base, and a cover section, wherein said front section, said rear section, said base, and said cover section form an interior of said body;

a first panel connecting said rear section;

a hood extending from said cover section;

a second panel connecting said hood;

shoulder straps connecting said rear section for allowing a user to carry said bulletproof backpack; and, strap connectors extending from said hood, wherein each of said first panel and said second panel is capable of blocking bullets and explosion fragments and protect the user's back and head, respectively; and, wherein said strap connectors connect said shoulder straps to balance weight of said hood and prevent said hood from falling back.

2. The bulletproof backpack of claim 1, wherein said shoulder straps comprise strap panels, wherein said strap panels are capable of blocking bullets and explosion fragments for protecting the user's torso area.

3. The bulletproof backpack of claim 1, wherein said strap connectors wrap around said hood, and wherein said hood folds back and positions over said cover section.

4. The bulletproof backpack of claim 1, wherein said cover section provides access to said interior of said body.

5. The bulletproof backpack of claim 1, wherein said second panel is contoured for comfort around a head and a neck area of the user.

6. The bulletproof backpack of claim 1, further comprises a connecting panel, wherein said connecting panel connects said first panel and said second panel.

7. The bulletproof backpack of claim 1, wherein each of said first panel and said second panel comprises a cushion member to provide comfort to the user.

8. The bulletproof backpack of claim 1, wherein said strap connectors connect to said shoulder straps via hook and loops.

9. The bulletproof backpack of claim 1, wherein said shoulder straps comprise a connecting mechanism, wherein said connecting mechanism helps to distribute weight of said bulletproof backpack evenly over the shoulders of the user, and wherein said connecting mechanism comprises a buckle mechanism.

10. A bulletproof backpack, comprising:

a body comprising a front section, a rear section, a base, and a cover section, wherein said front section, said rear section, said base, and said cover section form an interior of said body;

a first panel connecting said rear section;

a hood extending from said cover section;

a second panel connecting said hood;

shoulder straps connecting said rear section for allowing a user to carry said bulletproof backpack, wherein said shoulder straps comprise strap panels; and, strap connectors extending from said hood, wherein each of said first panel, said second panel and said strap panels is capable of blocking bullets and explosion fragments for protecting the user's back, head and torso area, respectively; and, wherein said strap connectors connect said shoulder straps to balance weight of said hood and prevent said hood from falling back.

11. The bulletproof backpack of claim 10, wherein said strap connectors wrap around said hood, and wherein said hood folds back and positions over said cover section.

12. The bulletproof backpack of claim 10, wherein said cover section provides access to said interior of said body.

13. The bulletproof backpack of claim 10, wherein said second panel is contoured for comfort around a head and neck area of the user.

14. The bulletproof backpack of claim 10, further comprises a connecting panel, wherein said connecting panel connects said first panel and said second panel.

15. The bulletproof backpack of claim 10, wherein each of said first panel, said second panel and said strap panels comprises a cushion member to provide comfort to the user.

16. The bulletproof backpack of claim 10, wherein said strap connectors connect to said shoulder straps via hook and loops.

17. The bulletproof backpack of claim 10, wherein said shoulder straps comprises a connecting mechanism, and wherein said connecting mechanism helps to distribute the weight of said bulletproof backpack evenly over the shoulders of the user.

18. A method of providing a bulletproof backpack, said method comprising the steps of:

providing a body comprising a front section, a rear section, a base, and a cover section, said front section, said rear section, said base, and said cover section forming an interior of said body;

providing a hood extending from said cover section;

providing a first panel connecting said rear section, and a second panel connecting said hood, said first panel and said second panel capable of blocking bullets and explosion fragments and protecting a user's back and head, respectively;

providing shoulder straps connecting said rear section for allowing the user to carry said bulletproof backpack;

providing strap connectors extending from said hood; and connecting said strap connectors to said shoulder straps for balancing weight of said hood and preventing said hood from falling back.

19. The method of claim 18, further comprising providing strap panels within said shoulder straps, said strap panels capable of blocking bullets and explosion fragments for protecting the user's torso area.

20. The method of claim 19, further comprising providing a connecting mechanism at said shoulder straps, said connecting mechanism configured for distributing the weight of said bulletproof backpack evenly over the shoulders of the user.

* * * * *